US011261533B2

(12) United States Patent
Groechel et al.

(10) Patent No.: US 11,261,533 B2
(45) Date of Patent: Mar. 1, 2022

(54) ALUMINUM PLATING AT LOW TEMPERATURE WITH HIGH EFFICIENCY

(71) Applicant: Applied Materials, Inc., Santa Clara, CA (US)

(72) Inventors: David W. Groechel, Los Altos Hills, CA (US); Gang Peng, Fremont, CA (US); Robert Mikkola, Kalispell, MT (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 15/884,006

(22) Filed: Jan. 30, 2018

(65) Prior Publication Data

US 2018/0230616 A1 Aug. 16, 2018

Related U.S. Application Data

(60) Provisional application No. 62/457,542, filed on Feb. 10, 2017.

(51) Int. Cl.
*C25D 3/44* (2006.01)
*C25D 5/00* (2006.01)
(Continued)

(52) U.S. Cl.
CPC ..... *C25D 5/623* (2020.08); *C25D 3/44* (2013.01); *C25D 3/665* (2013.01); *C25D 5/003* (2013.01);
(Continued)

(58) Field of Classification Search
CPC ..... C25D 3/665
See application file for complete search history.

(56) References Cited

U.S. PATENT DOCUMENTS 1,947,981 A 2/1934 Fischer
1,968,483 A 7/1934 Fischer
(Continued)

FOREIGN PATENT DOCUMENTS

EP 0404188 B1 3/1994
JP 07157891 A 6/1995
(Continued)

OTHER PUBLICATIONS

Natter et al.; "Electrochemical Deposition of Nanostructured Metals and Alloys from Ionic Liquids" Z. Phys. Chem., 220, p. 1275-1291, 2006. (Year: 2006).*
(Continued)

*Primary Examiner* — Brian W Cohen
(74) *Attorney, Agent, or Firm* — Patterson + Sheridan, LLP

(57) ABSTRACT

The present disclosure generally relates to methods of electro-depositing a crystalline layer of pure aluminum onto the surface of an aluminum alloy article. The methods may include positioning the article and an electrode in an electro-deposition solution. The electro-deposition solution includes one or more of an aluminum halide, an organic chloride salt, an aluminum reducing agent, a solvent such as a nitrile compound, and an alkali metal halide. The solution is blanketed with an inert gas, agitated, and a crystalline layer of aluminum is deposited on the article by applying a bias voltage to the article and the electrode.

18 Claims, 2 Drawing Sheets

(51) Int. Cl.

| | |
|---|---|
| ***C25D 5/18*** | (2006.01) |
| ***C25D 3/66*** | (2006.01) |
| ***C25D 17/02*** | (2006.01) |
| ***C25D 21/10*** | (2006.01) |

(52) U.S. Cl.
CPC ..... *C25D 5/18* (2013.01); *C25D 5/617* (2020.08); *C25D 17/02* (2013.01); *C25D 21/10* (2013.01)

(56) References Cited

U.S. PATENT DOCUMENTS

| | | | | |
|---|---|---|---|---|
| 2,541,083 | A | 2/1951 | McDermott | |
| 4,071,526 | A | 1/1978 | Dotzer et al. | |
| 5,074,973 | A * | 12/1991 | Takahashi | C25D 3/44 205/234 |
| 5,158,663 | A | 10/1992 | Yahalom | |
| 10,030,312 | B2 * | 7/2018 | Ruan | C25D 3/665 |
| 10,590,558 | B2 * | 3/2020 | Freydina | C25D 7/00 |
| 2004/0137147 | A1 | 7/2004 | O'Donnell et al. | |
| 2008/0017516 | A1 | 1/2008 | Han et al. | |
| 2008/0257744 | A1 | 10/2008 | Lodermeyer et al. | |
| 2010/0112378 | A1 | 5/2010 | Deininger et al. | |
| 2012/0052324 | A1 | 3/2012 | Inoue et al. | |
| 2012/0138472 | A1 | 6/2012 | Han et al. | |
| 2012/0144640 | A1 | 6/2012 | Shih et al. | |
| 2013/0168258 | A1 | 7/2013 | Nakano et al. | |
| 2013/0292255 | A1 | 11/2013 | Inoue et al. | |
| 2013/0299355 | A1 * | 11/2013 | Yu | C25D 3/665 205/107 |
| 2014/0272458 | A1 * | 9/2014 | Ruan | C25D 3/44 428/650 |
| 2015/0275375 | A1 | 10/2015 | Kim et al. | |
| 2015/0292098 | A1 * | 10/2015 | Benaben | C25D 3/10 205/262 |
| 2015/0322582 | A1 * | 11/2015 | Freydina | C25D 5/44 428/629 |
| 2016/0108533 | A1 * | 4/2016 | Dai | C25D 3/665 |
| 2017/0002474 | A1 | 1/2017 | Nishimura et al. | |
| 2017/0260639 | A1 | 9/2017 | Pareek et al. | |

FOREIGN PATENT DOCUMENTS

| | | | |
|---|---|---|---|
| JP | 2011-084798 | A | 4/2011 |
| WO | 99/40241 | A2 | 8/1999 |
| WO | 2012/043129 | A1 | 4/2012 |

OTHER PUBLICATIONS

PCT International Search Report and Written Opinion dated May 18, 2018, for International Application No. PCT/US2018/016114.

* cited by examiner

ALUMINUM PLATING AT LOW TEMPERATURE WITH HIGH EFFICIENCY

CROSS-REFERENCE TO RELATED APPLICATIONS

This application claims priority to U.S. Provisional Application Ser. No. 62/457,542 filed on Feb. 10, 2017, which is herein incorporated by reference in its entirety.

BACKGROUND

Field

Embodiments of the present disclosure generally relate to methods of forming protective aluminum layers on components used in semiconductor device manufacturing processes, and more particularly, to electro-deposition of aluminum layers on aluminum alloy components used in the manufacturing of electronic devices.

Description of the Related Art

Often, semiconductor device processing equipment components, such as processing chamber components, are formed of aluminum alloys that provide desirable mechanical and chemical properties, such as tensile strength, density, ductility, formability, workability, weldability, and corrosion resistance. In addition to aluminum, alloys used in processing chamber components typically include elements such as copper, magnesium, manganese, silicon, tin, zinc, or combinations thereof which are chosen to desirably improve the mechanical and, or, chemical properties of the processing chamber components when compared to pure aluminum. Unfortunately, during substrate processing in the processing chamber, these elements will undesirably migrate from the processing chamber component to other surfaces of the processing chamber, including substrates processed therein, resulting in trace metal contamination thereof. Trace metal contamination is detrimental to semiconductor devices formed on the substrate, rendering the devices non-functional or contributing to a degradation in device performance and, or, the usable lifetime thereof.

Conventional methods of preventing migration of non-aluminum alloy elements from surfaces of the aluminum alloy components include coating the aluminum alloy component with a layer of pure aluminum, herein an aluminum barrier layer, using a physical vapor deposition (PVD) process, a chemical vapor deposition (CVD) process, a plasma spraying process, or an aerosol deposition process. Typically, these methods provide a pure aluminum layer on the surface of the processing component having poor porosity and thus poor barrier properties. As a result, conventionally formed aluminum barrier layers do not prevent non-aluminum alloy precipitants from reaching surfaces of the processing component where they pose the trace metal contamination problem described above.

Accordingly, there is a need in the art for improved aluminum deposition methods for forming barrier layers on processing components used in electronic device manufacturing.

SUMMARY

Embodiments of the disclosure provide an electro-deposition solution and methods for depositing aluminum onto an article formed of an aluminum ahoy using the electro-deposition solution. In particular, the embodiments described herein may be used to deposit a crystalline aluminum layer on one or more surfaces an aluminum alloy article to be used as a processing component in a semiconductor device manufacturing processing chamber.

In one embodiment, a method of depositing aluminum on an article formed of an aluminum alloy is provided. The method includes positioning an article, formed of an aluminum alloy, in an electro-deposition solution. The electro-deposition solution includes an aluminum halide, an organic chloride salt; and an aluminum reducing agent. The method further includes blanketing the electro-deposition solution with an inert gas, agitating the electro-deposition solution, creating an electrical current between an electrode disposed in the electro-deposition solution and the article; and depositing an aluminum layer onto one or more surfaces of the article.

In another embodiment, a method of depositing aluminum is provided. The method includes positioning an aluminum alloy article in an electro-deposition apparatus, the electro-deposition apparatus containing a solution comprising $AlCl_3$, wherein the $AlCl_3$ concentration is between about 1 mol/L and about 5 mol/L, an organic chloride salt, an aluminum reducing agent, wherein the aluminum reducing agent concentration is between about 0.1 mol/L and about 0.5 mol/L, and a solvent. The method further includes applying a bias voltage to the aluminum alloy article of between about 1 volt and about 100 volts and depositing an aluminum layer on the aluminum alloy article.

In another embodiment, a method of depositing aluminum is provided. The method includes positioning an aluminum alloy article in an electro-deposition solution, the electro-deposition solution comprising $AlCl_3$, wherein the $AlCl_3$ concentration is between about 1 mol/L and about 5 mol/L, 1-ethyl-3-methylimidazolium chloride, $LiAlH_4$, wherein the $LiAlH_4$ concentration is between about 0.1 mol/L and about 0.5 mol/L, KF, wherein the KF concentration is between about 0.1 mol/L and about 0.5 mol/L, and a nitrile solvent selected from the group consisting of acetonitrile, pyrrole, propionitrile, butyronitrile, pyridine, and combinations thereof. The method further includes applying a bias voltage to the aluminum alloy article of between about 1 volt and about 100 volts, and depositing a crystalline aluminum layer on the aluminum alloy article.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

Embodiments of the disclosure provide an electro-deposition solution and methods for depositing aluminum onto an article formed of an aluminum alloy using the electro-deposition solution. In particular, the embodiments described herein may be used to deposit a crystalline aluminum layer on one or more surfaces an aluminum alloy article for use as a processing component in a semiconductor device manufacturing processing chamber. The crystalline aluminum layer is typically deposited to a thickness of about 100 μm or less, such as about 1 μm to about 50 μm, such as about 2 μm to about 20 μm. In some embodiments, an aluminum deposition rate using the methods described herein is more than about 1 μm/hr, such as more than about 3 μm/hr. For example, according to one embodiment, the aluminum deposition rate on a cylindrical article, formed of an aluminum alloy and having a diameter of about 1.5 cm and a height of about 1.0 cm is about 3 μm/hr.

Figure 1:
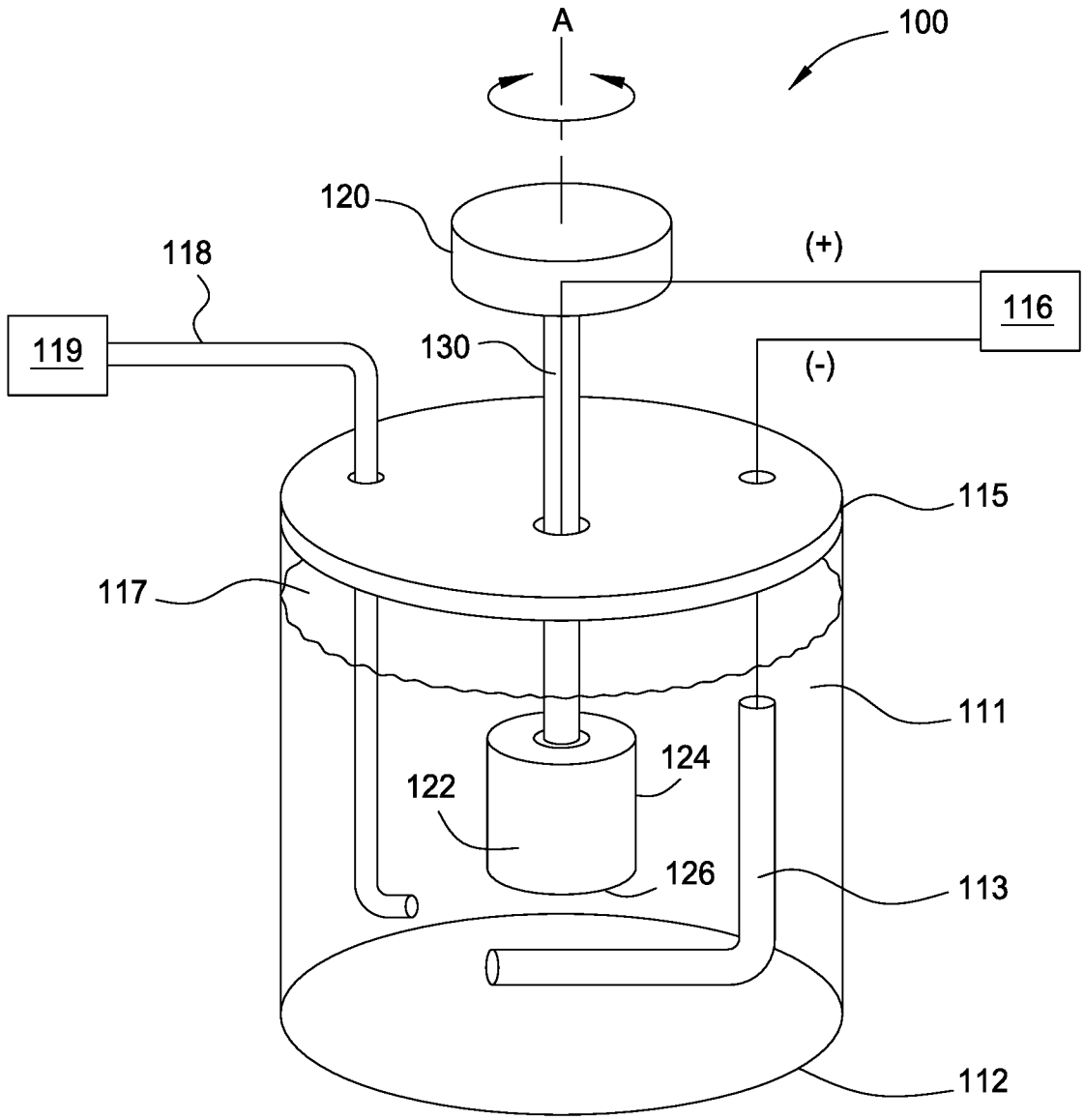
FIG. 1 is a schematic view an example electro-deposition apparatus used to practice the methods described herein, according to one embodiment.

FIG. 1 is a schematic view of an example electrodeposition electro-deposition apparatus used to practice the methods described herein, according to one embodiment. The electro-deposition apparatus 100 herein includes a container 112 having a lid 115 disposed thereon which contains an electro-deposition solution 111, a rotatable support shaft 130 for rotating an article 122 secured thereto while the article 122 is disposed in the electro-deposition solution 111, and an electrode 113 disposed in the electro-deposition solution 111. Herein, the article 122 and the electrode 113 are electrically coupled to a power supply 116, such as a DC power supply. In one embodiment, the electrode 113 is an anode; that is, the electrode 113 is negatively biased by the power supply 116. In this embodiment, the article 122 is positively biased by the power supply 116 and is a cathode. In other embodiments, a polarity of the electrode 113 and the article 122 is alternated so that an aluminum deposition process on the article 122 alternates with an aluminum removal process in order to finely control the aluminum deposition process on one or more surfaces of the article 122.

In one embodiment, the electrode 113 comprises a shape where a plurality of segments and, or, portions thereof are parallel to a respective plurality of surfaces of the article 122. For example, an electrode 113 used to deposit aluminum on a cylindrical article 122 having both a vertical surface 124 and a horizontal surface 126 has a plurality of segments forming a right angle wherein a first segment of the plurality is parallel to the vertical surface 124 of the article 122 and a second segment of the plurality of segments is parallel to the horizontal surface 126 of the article 122.

The support shaft 130 is coupled to an actuator 120 which rotates the support shaft 130, and, or, the article 122 coupled thereto, about a vertical axis A. A bubble line 118 disposed through the lid 115 provides an inert gas from an inert gas source 119 to the electro-deposition solution 111 disposed in the container 112. The inert gas forms a blanket layer 117 between the electro-deposition solution 111 and the lid 115 and reduces exposure of the electro-deposition solution 111, and the article 122 disposed therein, to the oxygen containing atmosphere outside of the electro-deposition apparatus 100. In some embodiments, the electro-deposition apparatus 100 further includes a mixer (not shown) for mixing and, or, agitating the electro-deposition solution 111 before and, or, during the electro-deposition process.

Figure 2:
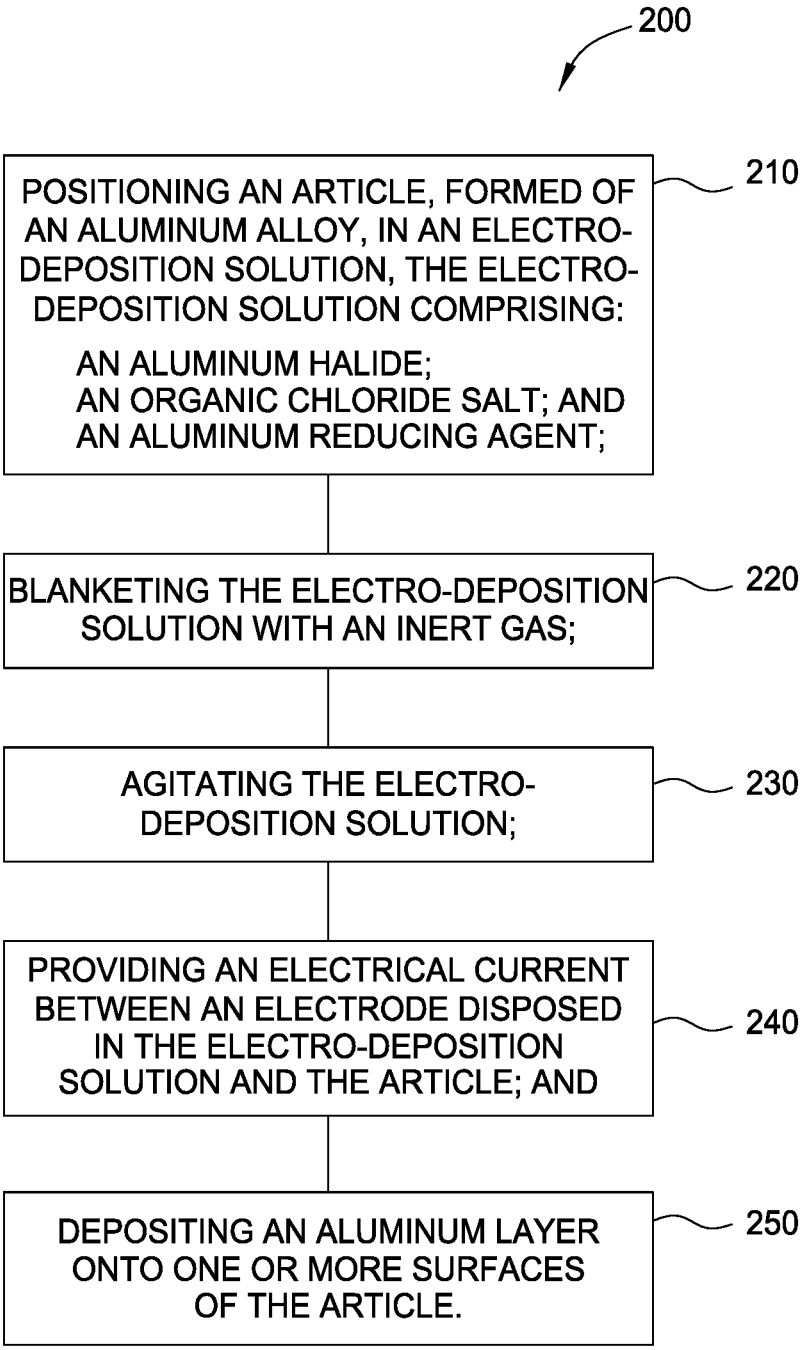
FIG. 2 is a flow diagram of a method for electro-depositing aluminum on an aluminum alloy article, according to embodiments described herein.

FIG. 2 is a flow diagram of a method of electro-depositing aluminum onto an aluminum alloy article, according to embodiments described herein. Activity 210 of the method 200 includes positioning an article 122, formed of an aluminum alloy, in an electro-deposition solution contained in an electro-deposition apparatus, such as the electro-deposition apparatus 100 described in FIG. 1. Herein the electro-deposition solution includes an aluminum halide, an organic chloride salt, and an aluminum reducing agent. The aluminum halide and the organic chloride salt form an ionic liquid comprising ionic pairs. Examples of aluminum halides herein include, $AlF_3$, $AlCl_3$, $AlBr_3$, $AlI_3$, or combinations thereof. Examples of organic chloride salts include imidazolium chlorides, alkylimidazolium chlorides, dialkylimidazolium chlorides, or combinations thereof. Examples of dialkylimidazolium chlorides include 1-butyl-3-methylimidazolium chloride, 1-ethyl-3-methylimidazolium chloride, and 1-ethyl-3-methyl imidazolium chloride. In some embodiments, the organic chloride salt includes 1-butylpyridinium chloride. Herein, the ionic liquid has an aluminum halide concentration of between about 0.1 mol/L and about 3 mol/L, such as about 2 mol/L. The reducing agent reduces aluminum ions in the electroplating bath solution to a metallic form. Examples of aluminum reducing agent include aluminum hydrides, such as $LiAlH_4$, and, or, an alkyl aluminum hydride, such as diisobutylaluminum hydride, trimethylaluminum hydride, triethylaluminum hydride, or a combination thereof. The concentration of the aluminum reducing agent in the electrodeposition bath solution is typically between about 0.001 mol/L and about 2 mol/L, such as between about 0.1 mol/L and about 0.5 mol/L.

In another embodiment, the electro-deposition solution further includes an alkali metal halide, such as KF. The concentration of the alkali metal halide is typically between 0.001 mol/L and about 2 mol/L, such as between about 0.1 mol/L and about 0.5 mol/L.

In another embodiment, the electro-deposition solution includes an ionic liquid, an aluminum reducing agent, and a solvent, such as a nitrile solvent, for example acetonitrile, propionitrile, or butyronitrile, or another solvent compound comprising nitrogen, as pyridine, pyrrole, or a combination thereof. Typically, the solvent comprises between 5 vol. % and 95 vol. % of the electro-deposition solution, the concentration of the aluminum reducing agent is between about 0.001 mol/L and about 2 mol/L, such as between about about 0.1 mol/L and about 0.5 mol/L, and the aluminum halide concentration is between about 1 mol/L and about 5 mol/L, such as about 3 mol/L. In some further embodiments the electroplating solution includes an alkali metal halide, for example KF. The concentration of the alkali metal halide is typically between 0.001 mol/L and about 2 mol/L, such as between about 0.1 mol/L and about 0.5 mol/L.

Activity 220 of the method 200 includes blanketing the electro-deposition solution with an inert gas. Typically, the inert gas is introduced to the electro-deposition solution through a bubble line disposed therein to form a blanket layer thereover. Examples of inert gases include nitrogen, argon, krypton, or any other suitable non-reactive gas.

Activity 230 of the method 200 includes agitating the electro-deposition solution to cause an average flowrate of the electro-deposition solution near the surfaces of the article. The electro-deposition solution herein is agitated by moving the article, by moving the electro-deposition solution, or both. Moving the article includes rotating a support shaft coupled thereto about a vertical axis A. Moving the electro-deposition solution includes using a suitable method such as stirring the electro-deposition solution with a mixer. Maintaining a flowrate between the electro-deposition solution and surfaces of the article at the article surface results in increased current density (current per unit area of the electrode) for the electro-deposition process. However, once a fluid boundary layer surrounding surfaces of the article is dissipated further increases in flowrate will have reduced effect on current density. Therefore, the amount of agitation necessary to dissipate the fluid boundary layer at surfaces of the article will depend on the shape and size of the article, the geometry of the electro-deposition apparatus container, and the viscosity of the solution among other factors. In one embodiment, the average flowrate near surfaces of the article, for example a vertical surface of the article described in FIG. 1, that is required to dissipate the fluid boundary layer is between about 0.1 L/min and about 10 L/min, such as between about 3 L/min and about 7 L/min, such as about 5 L/min.

At activity 240 the method 200 includes creating an electrical current, herein a DC current, between an electrode and the article, where the electrode is disposed in the electro-deposition solution, functions as an anode, and is positioned in the container of the electro-deposition solution so it is wholly or at least partially submersed therein and further positioned to prevent physical contact with the article. In some embodiments, the electrode comprises a shape, such as a right angle shape, where one or more segments and, or, portions of the electrode are parallel to one or more surfaces of the to be electroplated article. The electrode and the article are coupled to a power supply, such as a DC power supply, or a pulsed DC power supply, to facilitate plating of aluminum onto the article. In one embodiment, the electrode is formed of aluminum, platinum, or a combination thereof. Herein, the article is formed of an aluminum ahoy, such as an ahoy comprising aluminum and one of copper, magnesium, manganese, silicon, tin, zinc, or combinations thereof.

At activity 250 the method 200 includes depositing an aluminum layer on the article. In one embodiment, the electrode is positively biased by the power supply, while the article is negatively biased by the power supply. Biasing of the electrode and the article facilitates plating of the aluminum from the solution on to the article. The electrode and the article are typically biased with a voltage in the range of about 1 volt to about 10 volts, such as about 1 volt to about 5 volts. In one example, the anode and article are biased with a voltage within a range of about 1 volt to about 5 volts in a solution comprising an aluminum reducing agent, as the aluminum reducing agent facilitates deposition of aluminum at relatively low voltages. The electro-deposition process is a continuous process or a pulsing process where the DC current is maintained at a desired value or is pulsed from a minimum value to a maximum value respectively. In one embodiment, the pulsing process is continuous from the beginning of deposition to the end of deposition. In another embodiment, the pulsing process comprises a partial pulsing process wherein the pulsing process alternates with the continuous process towards the beginning, middle, or end of the electro-deposition process. In another embodiment, deposition and removal of the aluminum layer is alternated by alternating the polarity of the bias voltage in order to further control properties of the deposited film. In some embodiments, a current density of the process is between about 1 $mA/cm^2$ and about 20 $mA/cm^2$, such as between about 1 $mA/cm^2$ and about 10 $mA/cm^2$, such as between about 3 $mA/cm^2$ and 4.5 $mA/cm^2$.

Benefits the methods described herein include reduced porosity and improved barrier properties for an aluminum layer deposited on an aluminum alloy article. The reduced porosity and improved barrier properties result in in reduced migration of non-aluminum alloy metals, such as Mg, Cu, and Ti. Benefits of the methods described herein further include increased deposition rate at reduced costs when compared to conventional aluminum deposition methods.

While the foregoing is directed to embodiments of the present disclosure, other and further embodiments of the disclosure may be devised without departing from the basic scope thereof, and the scope thereof is determined by the claims that follow.

The invention claimed is:

1. A method of depositing aluminum, comprising:

positioning an article, formed of an aluminum alloy, in an electro-deposition solution, the electro-deposition solution comprising:

an aluminum halide;

an organic chloride salt;

an aluminum reducing agent; and a solvent consisting of acetonitrile, pyrrole, propionitrile, butyronitrile, pyridine, or a combination of two or more thereof;

blanketing the electro-deposition solution with an inert gas;

agitating the electro-deposition solution;

creating an electrical current between an electrode disposed in the electro-deposition solution and the article; and depositing a crystalline layer of pure aluminum onto one or more surfaces of the article while the article is positioned in the electro-deposition solution, wherein depositing the crystalline layer of pure aluminum is based on the electrical current.

2. The method of claim 1, wherein the organic chloride salt is imidazolium chloride, 1-butyl-3-methylimidazolium chloride, 1-ethyl-3-methylimidazoliurn chloride, 1-butylpyridinium chloride, or a combination thereof.

3. The method of claim 2, wherein the aluminum halide is $AlF_3$, $AlCl_3$, $AlBr_3$, $AlI_3$, or a combination thereof.

4. The method of claim 3, wherein an aluminum halide concentration is between about 1 mol/L and about 3 mol/L.

5. The method of claim 3, wherein an aluminum halide concentration in the electro-deposition solution is between about 1 mol/L and about 5 mol/L.

6. The method of claim 1, wherein the aluminum reducing agent is LiAlH4, diisobutylaluminum hydride, trimethylaluminum hydride, triethylaluminum hydride, or a combination thereof.

7. The method of claim 6, wherein the aluminum reducing agent concentration in the electro-deposition solution is between about 0.1 mol/L and about 0.5 mol/L.

8. The method of claim 1, wherein the electro-deposition solution further comprises an alkali metal halide, wherein an alkali metal halide concentration is between about 0.1 mol/L and about 0.5 mol/L.

9. The method of claim 8, wherein the alkali metal halide is KF.

10. The method of claim 1, wherein depositing the crystalline layer of pure aluminum comprises applying a bias voltage to the article between about 1 volt and about 100 volts.

11. The method of claim 10, wherein the bias voltage is pulsed.

12. The method of claim 10, wherein a polarity of the electrical current between the electrode and the article is alternated.

13. The method of claim 1, wherein an aluminum deposition rate is more than about 3 μm per hour.

14. A method of depositing aluminum, comprising:

positioning an aluminum alloy article in electro-deposition solution in an electro-deposition apparatus, the electro-deposition solution comprising:

$AlCl_3$, wherein the $AlCl_3$ concentration is between about 1 mol/L and about 5 mol/L;

an organic chloride salt;

an aluminum reducing agent, wherein the aluminum reducing agent concentration is between about 0.1 mol/L and about 0.5 mol/L; and a solvent consisting of acetonitrile, pyrrole, propionitrile, butyronitrile, pyridine, or a combination of two or more thereof;

applying a bias voltage through the electro-deposition solution, the bias voltage being between about 1 volt and about 100 volts; and depositing a crystalline layer of pure aluminum on the aluminum alloy article while the aluminum alloy article is positioned in the electro-deposition solution, wherein depositing the crystalline layer of pure aluminum is based on the bias voltage.

15. The method of claim 14, wherein the organic chloride salt is 1-butyl-3-methylimidazolium chloride, 1-ethyl-3-methylimidazolium chloride, 1-butylpyridinium chloride, or a combination thereof.

16. The method of claim 14, wherein the aluminum reducing agent is $LiAlH_4$, diisobutylaluminum hydride, trimethylaluminum hydride, triethylaluminum hydride, or a combination thereof.

17. The method of claim 14, wherein the electro-deposition solution further comprises KF at a concentration of between about 0.1 mol/L and 0.5 mol/L.

18. A method of depositing aluminum, comprising:

positioning an aluminum alloy article in an electro-deposition solution, the electro-deposition solution comprising:

$AlCl_3$, wherein the $AlCl_3$ concentration is between about 1 mol/L and about 5 mol/L;

1-ethyl-3-methylimidazolium chloride;

$LiAlH_4$, wherein an $LiAlH_4$ concentration is between about 0.1 mol/L and about 0.5 mol/L;

KF, wherein the KF concentration is between about 0.1 mol/L and about 0.5 mol/L; and a solvent selected from the group consisting of acetonitrile, pyrrole, propionitrile, butyronitrile, pyridine, and combinations thereof;

applying a bias voltage to the aluminum alloy article of between about 1 volt and about 100 volts; and depositing a crystalline layer of pure aluminum on the aluminum alloy article while the aluminum alloy article is positioned in the electro-deposition solution, wherein depositing the crystalline layer of pure aluminum is based on the bias voltage.

* * * * *